United States Patent [19]

Green

[11] 4,388,026

[45] Jun. 14, 1983

[54] HOPPER DISCHARGE OUTLET

[75] Inventor: Daniel R. Green, Griffith, Ind.

[73] Assignee: Union Tank Car, East Chicago, Ind.

[21] Appl. No.: 258,973

[22] Filed: Apr. 30, 1981

[51] Int. Cl.[3] ..... B65G 53/50

[52] U.S. Cl. ..... 406/130; 105/253; 105/282 P; 105/305; 222/505; 222/561

[58] Field of Search ..... 105/253, 280, 282 P, 105/282 R, 286, 305; 222/505, 506, 554, 556, 561; 298/24, 27, 28; 406/128, 130, 145, 158, 167, 177, 180

[56] References Cited

U.S. PATENT DOCUMENTS

| | | | |
|---|---|---|---|
| 3,693,846 | 9/1972 | Schuller | 406/145 X |
| 3,724,909 | 4/1973 | Adler | 406/128 X |
| 4,200,208 | 4/1980 | Hassenauer | 222/505 |

*Primary Examiner*—Randolph Reese
*Assistant Examiner*—David F. Hubbuch
*Attorney, Agent, or Firm*—Dressler, Goldsmith, Shore, Sutker & Milnamow, Ltd.

[57] ABSTRACT

An enclosed railroad car has hoppers at its underside for unloading a solid commodity. A pneumatic outlet trough is opened and closed by a slide valve or gate that is attached to operating rods supported in slide bearings. The gate can be safely removed from outside of the car by disengaging a pin that locks the gate to the operating rods.

6 Claims, 3 Drawing Figures

HOPPER DISCHARGE OUTLET

BACKGROUND OF THE INVENTION

This invention relates to the discharge of materials from containers, and more particularly to hoppers for emptying a solid commodity from a transportation vehicle such as a railroad hopper car.

The discharge hoppers used at the underside of railroad cars may be controlled by a sliding gate or valve member that is movable along a generally straight line path. These gates may become coated or fouled, they may wear out, or they may need to be cleaned, repaired or replaced for other reasons. In prior hopper arrangements, it has been necessary for the workman who services the gates to remove the entire hopper, or to enter the inside of the car itself, or to move under the car in a dangerous location over or between the rails, in order to have access to a defective or dirty gate.

OBJECTIVES OF THE INVENTION

Accordingly, it is an object of this invention to provide an improved discharge hopper for transportation vehicles.

Another object is to provide a hopper gate for a railroad car that can be removed from outside of the car without requiring workmen to be positioned over or between the rails.

Another object is to provide improved, easily replaced slide bearings for hopper gate operating mechanisms.

Another object is to provide a rugged, relatively economical, easily operated and maintained solid commodity discharge hopper for railroad cars that has exact metering capabilities, is safe, and which does not possess defects found in similar prior art devices.

Other objects and advantages of the invention will be found in the specification and claims, and the scope of the invention will be set forth in the claims.

DESCRIPTION OF THE INVENTION

Figure 1:
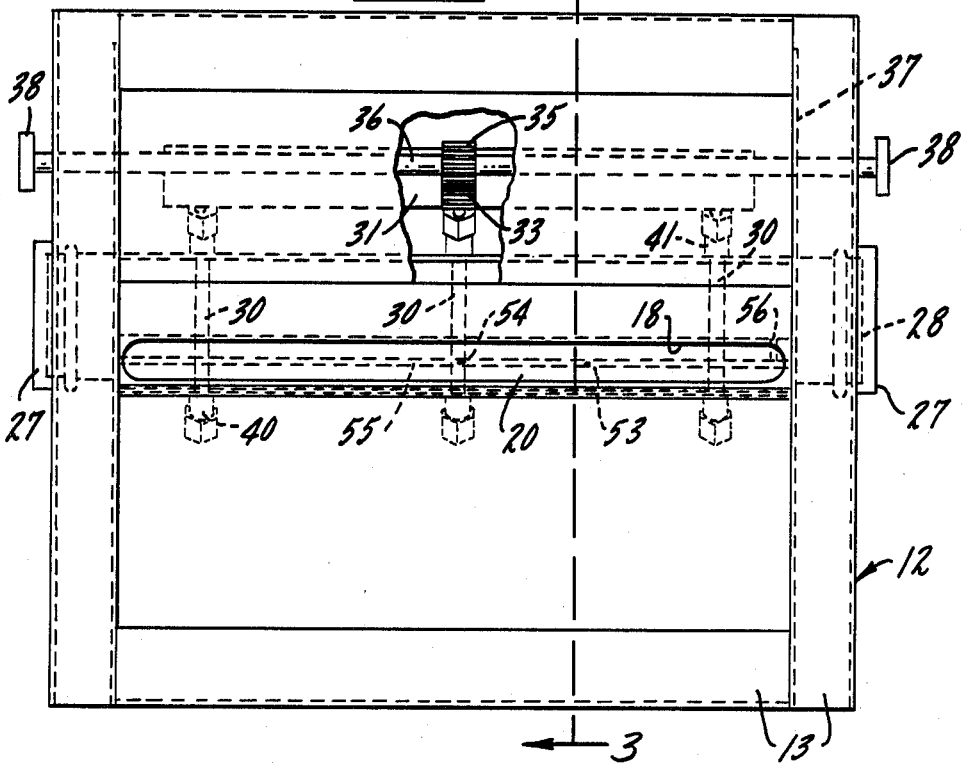
FIG. 1 is a top plan partial view of a railroad car having a discharge hopper in accord with the invention.
Figure 1:
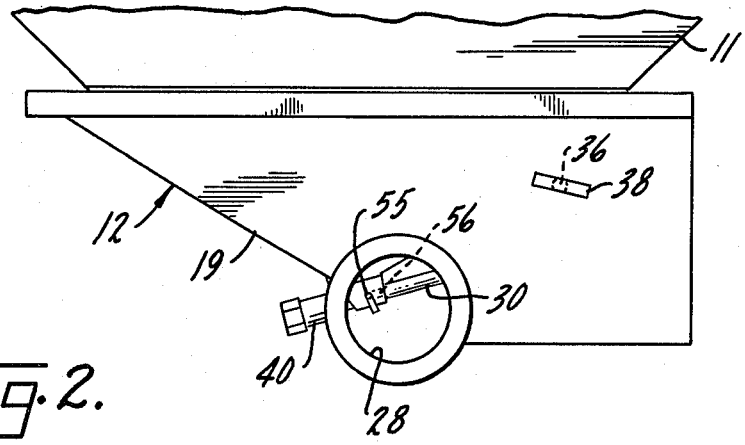
Figure 2:
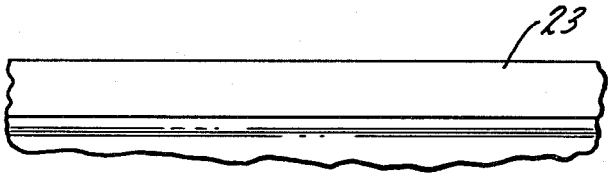
FIG. 2 is a side view of the hopper shown in FIG. 1 with the end cap removed.

The drawing shows a railroad car 10 having an enclosed tank body or vessel 11 for containing a solid commodity, such as pellets of PVC, ABS or other plastics. A plurality of identical discharge hopper outlets 12 are located at the underside of car 10 to facilitate unloading of the commodity. Each hopper 12 includes peripheral flanges 13 at its upper end for attachment to vessel 11. The upper side of sheets 15 have smooth hopper surfaces 16 that slope generally toward each other and define an included angle 17 of about 120°. Surfaces 16 terminate short of each other so as to define an elongated discharge slot 18 that extends transversely of car 10. Generally vertical side panels 19 close off the ends of hopper 12.

An outlet gate 20 is located below sloping surfaces 16, and the upper surface 21 of the gate slopes in the same general direction as the righthand hopper surface 16. Gate 20 is movable to open and close slot 18 along a predetermined path 22 that is generally longitudinal of car 10 in its direction of travel along rails 23. Gate 20 has equally-spaced, circular openings 24 passing completely through it, and openings 24 extend generally parallel to the gate path of travel 22. A hollow, generally circular, tubular housing 25 is attached to the underside of sheets 15. The inside of housing 25 defines an open-ended discharge trough 26 beneath gate 20. Removable end caps 27 may be used to close the commodity outlets 28 at opposite ends of trough 26. A source of suction or air pressure may be connected to outlets 28 in conventional manner to facilitate pneumatic unloading or loading of car 10.

A plurality of identical, elongated, cylindrical operating members or rods 30 extend through the openings 24 in gate 20. Rods 30 protrude beyond the opposite sides of gate 20. Plate means 31 having a flange 32 may be connected to an end of each of rods 30. The ends of rods 30 abut flange 32, and this keeps the ends of the rods aligned. A rack 33 is attached to plate means 31 in line with the rod 30 that passes through the hole 24 at the center of gate 20. A pinion 35 is mounted on a rotatable shaft 36 that is journaled in support plates 37. Pinion 35 meshes with rack 33, so rotation of a handle 38 on the end of shaft 36 can cause operating rods 30 to move back and forth along path 22.

Figure 3:
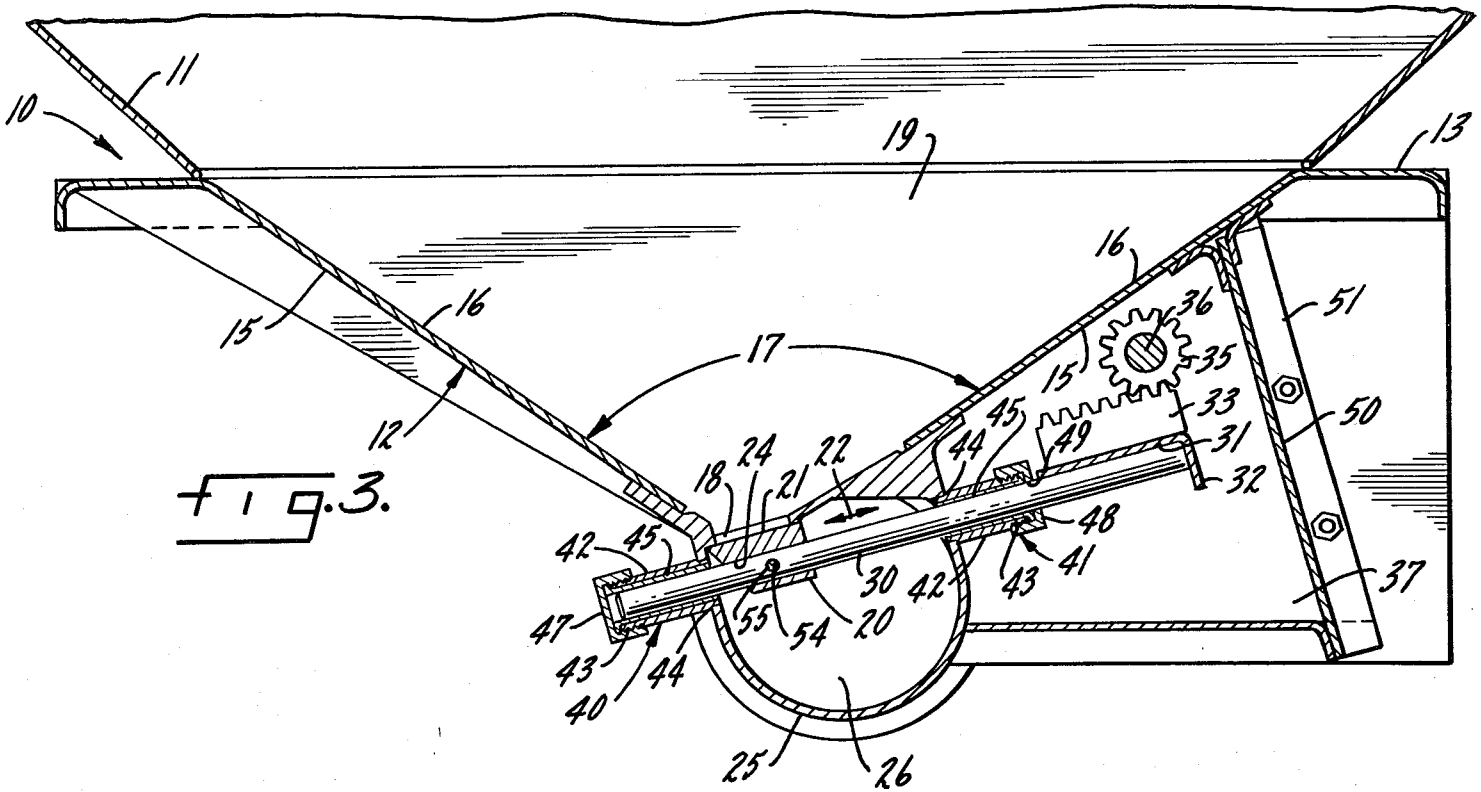
FIG. 3 is an enlarged fragmentary side view taken along the line 3—3 in FIG. 1.

Bearings 40 and 41 on the opposite sides of gate 20 support each operating rod in an inclined position corresponding to the slope of surface 21. Each bearing comprises a hollow cylindrical tube 42 having one externally threaded end 43 and having an opposite end 44 attached to the outside of trough 25. A removable bearing sleeve 45 is located inside of each tube 42, and rods 30 are slidably received in sleeves 45. Solid cap nuts 47 are threaded onto the unattached ends of the tubes 42 of bearings 40, and cap nuts 48 having a hole 49 therethrough are threaded onto the unattached ends of the tubes 42 of bearings 41. The ends of operating rods 30 that are attached to plate means 31 extend through and beyond the holes 49 in cap nuts 48. The opposite ends of rods 30 are aligned in bearings 40. As shown in FIG. 3, trough 25 controls the limit of travel of rods 30 in one direction along path 22. A backing plate 50 extends between support plates 37 and has flanges 51 attached to plates 37. Backing plate 50 provides a stop that controls the limit of travel of rods 30 in the opposite direction along path 22.

Gate 20 is releasably attached to operating rods 30 in such a manner that gate 20 can be removed by sliding it transversely of car 10 out of trough 25 through an outlet 28. A first circular hole 53 extends completely through gate 18 and intersects each opening 24 at its center. A second circular hole 54 passes through each rod 30. First and second holes 53 and 54 are aligned with each other in the openings 24, and holes 53 and 54 are generally perpendicular to path 22. An elongated cylindrical connecting pin 55 is movable into and out of trough 25 from the outside of car 10 in a direction generally perpendicular to path 22. Pin 55 is passed through the aligned first and second holes 53 and 54 and the openings 24 and thereby attaches gate 20 to rods 30. Means such as set screw 56 should be used to releasably hold pin 55 in place. When pin 55 is in place, gate 20 will move back and forth along path 22 with rods 30 as pinion 35 is rotated. To remove gate 20, set screw 56 is loosened, and the end of pin 55 is grasped and pulled transversely of car 10 until it has been removed from holes 53 and 54. Backing plate 50 is then removed. Next, pinion 35 is turned counterclockwise, as seen in FIG. 3, until rods 30 are moved out of bearings 40 and through openings 24 past gate 20. The gate can then be slid laterally out of trough 25.

It has thus been shown that by the practice of this invention a railroad hopper car 10 can be provided with a removable hopper gate 20 that does not present a safety hazard. Gate 18 can be removed from trough 25 by a worker located at the side of the car, and the worker need not be over or between rails 23. Hopper gate 20 can be positioned anywhere in slot 18 during unloading so that the metering characteristics of each hopper 12 can be set exactly as needed for each commodity under a variety of operating conditions. Bearings 40 and 41 are easily repaired or replaced, and caps 47 and 48 promote long life by protecting sleeves 45 from contamination.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A hopper outlet for discharging a solid commodity comprising:

A. means defining a sloping surface that terminates adjacent a discharge slot;

B. an outlet gate below said sloping surface movable along a predetermined path to open and close said slot, there being an opening passing through said gate, said opening extending generally parallel to said path;

C. an elongated gate operating member extending through said opening and protruding beyond the opposite sides of said gate, bearing means supporting said operating member on opposite sides of said gate, a rack attached to said operating member and a pinion meshing with said rack for causing movement of said operating member along said path when said pinion is rotated;

D. means for releasably attaching said gate to said operating member comprising a first hole through said gate intersecting said opening, a second hole through an intermediate portion of said operating member, said first and second holes being aligned in said opening and being generally perpendicular to said path, a pin movable in a direction generally perpendicular to said path passing through said first and second holes for attaching said first and second holes for attaching said gate to said operating member, and means releasably holding said pin in said first and second holes; and E. means defining an enclosed alongated trough beneath said gate, said pin being removable from one of the ends of said trough, whereby removal of said pin and subsequent movement of said operating member out of said opening permits said gate also to be removed through one of the ends of said trough.

2. The invention defined in claim 1, wherein the upper surface of said gate slopes in the same general direction as said sloping surface.

3. The invention defined in claim 1, wherein said bearing means are attached to the outside of said trough.

4. The invention defined in claim 3, wherein an end of said operating member extends through and beyond one of said bearings and said rack is attached to said member adjacent said end.

5. The invention defined in claim 3, wherein each of said bearings comprises a hollow tube having one externally threaded end and having another end secured to said trough, a removable apertured bearing sleeve inside of each tube, a cap nut threaded on said threaded end of each tube, one of said cap nuts having a hole therethrough, and said operating member extending through and beyond said one cap nut.

6. A railroad car comprising an enclosed vessel for a solid commodity and a plurality of hopper outlets at the bottom of said vessel for discharging said commodity, each of said hopper outlets comprising:

A. means defining hopper surfaces that slope generally towards each other, said hopper surfaces terminating at an elongated discharge slot that extends transversely of said car;

B. an outlet gate below said sloping surfaces movable to open and close said slot along a predetermined path that is generally longitudinal of said car, there being a plurality of openings passing completely through said gate, said openings extending generally parallel to said path, a housing defining an open-ended discharge trough beneath said gate;

C. an elongated gate operating rod extending through each of said openings and protruding beyond the opposite sides of said gate, means connecting said operating rods to each other at one end, a rack attached to said rod connecting means, and a pinion meshing with said rack for causing movement of said operating rods along said path when said pinion is rotated;

D. bearing means attached to the outside of said trough for supporting said operating rods on opposite sides of said gate, each such bearing means comprising a hollow tube having one externally threaded end and having an opposite end secured to the outside of said trough, a removable bearing sleeve inside of each tube, a cap nut threaded on each threaded end, one of said cap nuts having a hole therethrough, and said one end of each of said operating rods extending through and beyond said one cap nut;

E. means for releasably attaching said gate to said operating rods comprising a first hole through said gate intersecting said opening, a second hold through each of said operating rods, said first and second holes being aligned with each other in said opening and being generally perpendicular to said path, a connecting pin movable into and out of said trough from the outside of said trough in a direction generally perpendicular to said path, said pin passing through said first and second holes for attaching said gate to said operating rods, and means releasably holding said pin in said first and second holes, whereby removal of said pin and subsequent movement of said operating rods out of said openings permits said gate also to be removed from outside of said trough; and F. said means connecting said operating rods to each other comprises a plate having an upstanding flange against which said one end of each rod abuts, whereby the opposite ends of said operating rods are aligned in their bearings.

* * * * *